US011957183B1

(12) United States Patent
Bleiler-Sickels et al.

(10) Patent No.: US 11,957,183 B1
(45) Date of Patent: Apr. 16, 2024

(54) UNDERWEAR WITH FLY

(71) Applicant: Linnea Bleiler-Sickels, Los Angeles, CA (US)

(72) Inventors: Linnea Bleiler-Sickels, Los Angeles, CA (US); Lois Sickels, Dexter, MI (US)

( * ) Notice: Subject to any disclaimer, the term of this patent is extended or adjusted under 35 U.S.C. 154(b) by 0 days.

(21) Appl. No.: 18/488,035

(22) Filed: Oct. 17, 2023

Related U.S. Application Data

(60) Provisional application No. 63/577,741, filed on May 16, 2023.

(51) Int. Cl.
*A41B 9/00* (2006.01)
*A41B 9/02* (2006.01)
*A41B 9/14* (2006.01)

(52) U.S. Cl.
CPC ..... *A41B 9/005* (2013.01); *A41B 9/02* (2013.01); *A41B 9/026* (2013.01); *A41B 9/14* (2013.01)

(58) Field of Classification Search
CPC ..... A41B 9/005; A41B 9/02; A41B 9/026; A41B 9/14
See application file for complete search history.

(56) References Cited

U.S. PATENT DOCUMENTS 2,438,310 A * 3/1948 Ashe ..... A41B 9/02 2/403
5,669,902 A * 9/1997 Sivilich ..... A61F 13/471 604/397
7,788,739 B1 * 9/2010 Della Ratta ..... A41B 9/023 2/403
7,958,571 B2 * 6/2011 Kitsch ..... A41B 9/023 2/403
9,375,035 B1 * 6/2016 Ingels ..... A41B 9/02
10,986,877 B2 * 4/2021 Kimel ..... A41B 9/023
11,684,091 B2 * 6/2023 Calamia ..... A41B 9/026 2/405
2002/0053102 A1 * 5/2002 Vartanyan ..... A41D 7/005 2/403
2004/0006812 A1 * 1/2004 Truong ..... A41B 9/02 2/403
2005/0055755 A1 * 3/2005 Smith ..... A41D 1/089 2/405
2006/0000008 A1 * 1/2006 Chong ..... A41B 9/023 2/403

(Continued)

*Primary Examiner* — Khaled Annis
(74) *Attorney, Agent, or Firm* — Nolan Heimann LLP; Adam Diament

(57) ABSTRACT

An underwear with a fly is disclosed. The underwear includes a first panel, a first side panel extending from the first panel, and a second side panel extending the said first panel. The underwear includes a waistband connecting at the top of the first panel, the first side panel, and the second side panel. The underwear includes a first gusset fabric attached to the first panel, the first side panel, the second side panel and the waistband. The first gusset fabric includes a cut-section. The underwear includes a second gusset fabric attached to the first panel and the waistband. The second gusset fabric positions underneath said first gusset fabric and includes second openings at both sides. The cut-section provides access into an interior of the underwear through the second openings in order to allow ambidextrous access for left and right handed users.

13 Claims, 6 Drawing Sheets

(56) References Cited

U.S. PATENT DOCUMENTS

| | | | | |
|---|---|---|---|---|
| 2007/0283484 | A1* | 12/2007 | Wright | A41B 9/02 2/403 |
| 2010/0269243 | A1* | 10/2010 | Paree | A41B 9/005 2/243.1 |
| 2012/0260404 | A1* | 10/2012 | Steele | A41B 9/02 2/403 |
| 2017/0020203 | A1* | 1/2017 | Alexander | A41B 9/02 |
| 2017/0135875 | A1* | 5/2017 | Johnson | A61F 13/4906 |
| 2017/0280783 | A1* | 10/2017 | Nouh | A41B 9/005 |
| 2018/0310633 | A1* | 11/2018 | Harris | A41B 9/026 |
| 2019/0116889 | A1* | 4/2019 | Kimel | A41B 9/026 |
| 2019/0246706 | A1* | 8/2019 | Fortier | A41B 9/026 |
| 2019/0254353 | A1* | 8/2019 | Patton | A61F 2/26 |
| 2021/0106068 | A1* | 4/2021 | Black | A61F 5/44 |
| 2022/0015460 | A1* | 1/2022 | Lam | A41B 9/02 |
| 2022/0079251 | A1* | 3/2022 | Calamia | A41B 9/026 |
| 2022/0361591 | A1* | 11/2022 | Padgett | A41B 9/005 |
| 2022/0378115 | A1* | 12/2022 | Kimel | A41B 9/026 |

* cited by examiner

UNDERWEAR WITH FLY

CROSS-REFERENCE TO RELATED APPLICATIONS

This application claims benefit of and priority to U.S. Provisional Patent Application No. 63/577,741, filed May 19, 2023, to Bleiler-Sickels et al., the contents of which are incorporated by reference in their entirety.

FIELD OF THE DISCLOSURE

The present invention relates to underwear, and more specifically, to underwear with a dual opening fly.

BACKGROUND OF THE INVENTION

It is known that there are many types of underwear that are commercially available for both men and women. Some of the underwear have an opening at the crotch, commonly referred to as a fly. The fly provides access for male or female genitalia for sanitary functions.

A typical underwear includes an overlapping fabric that is attached at the waistband and below the opening, between 4-7 inches from the waistband. The fly goes side to side and in some instances include one or more buttons to keep the fly closed or for decorative purposes. Another underwear design includes a fly made up of a fabric extending from the center front waistband down being overlapped by a few inches with a secondary piece of fabric extending upwards from the inseam towards but stopping short of the waistband. Yet another underwear design foregoes the fly, opting for a shaped seam down the center front that creates a pouch to accommodate male genitalia.

Several other underwear with a fly have also been disclosed in the past. One such example is disclosed in a U.S. Pat. No. 11,684,091, entitled "Underwear with folded diagonal fly" ("the '091 Patent"). The '091 Patent discloses an underwear that includes a front body portion and a rear body portion. The underwear includes a waistband attached to edges of the front body portion and the rear body portion. The underwear further includes an interior pouch panel. The underwear also includes an exterior pouch panel overlaying the interior pouch panel and attached to the front body portion. The exterior pouch panel includes a folded edge arranged at an oblique angle with respect to the waistband that provides an opening into the interior of the underwear.

Another example is disclosed in a U.S. Pat. No. 7,958,571, entitled "Underwear garment for a male" ("the '571 Patent"). The '571 Patent discloses an underwear garment for use by a male, that is, a person having a penis and a scrotum, may be characterized as including a genital pouch and a pair of side panels collectively formed in a mid-section of a front wall depending from a waistband so as to bisect said front wall. The pouch may be pear-shaped when viewed from the front. A lower extremity of the pouch extends under and rearwardly of the front wall so as to form a perineum portion for covering rearwardly past the scrotum and to the perineum of the user. The pouch also has a phallus supporting portion extending forwardly of a plane generally containing the front wall and forming therein an apex portion for containing the head of the penis of the user when the penis is hanging at rest. The pouch also has a scrotum supporting portion extending from and between the phallus supporting portion and the perineum portion for containing at least a portion of the scrotum of the user.

Although the above discussed underwear are useful, they have few problems. For example, most of the underwear are gender specific i.e., they can be used either by men or women. Further, traditional men's underwear fly's only fit male genitalia. On female genitalia, excess fabric pouches out. Furthermore, the existing underwear leave gapping, a wrinkly pouch at the center front if a person with female genitalia wore the underwear.

Still, there remains a continuing need for improved undergarments or underwear with fly that works equally well for male and female genitalia.

BRIEF SUMMARY OF THE PRESENT INVENTION

The present invention provides an underwear with a fly having a symmetrical design that expands to accommodate male genitalia or lays flat against female genitalia.

In one aspect of the present invention, the invention provides an underwear with a fly that works equally well for male and female genitalia, as well as provides ambidextrous access for left and right handed people. The underwear includes one of a brief, a bikini brief, a boxer brief, a boxer, a long underwear, a short, a trunk, and combination thereof. The underwear includes a first panel, a first side panel extending from the first panel, and a second side panel extending the said first panel. The underwear includes a waistband connecting at the top of the first panel, the first side panel, and the second side panel. The underwear includes a first gusset fabric attached to the first panel, the first side panel, the second side panel and the waistband. The first gusset fabric includes a cut-section, a first opening or a fly. The cut-section positions vertically with respect to the first side panel and the second side panel. Alternatively, the cut-section positions in a top down configuration or at a side of the first gusset fabric in a curved configuration. The underwear includes a second gusset fabric attached to the first panel and the waistband. The second gusset fabric positions underneath said first gusset fabric and includes second openings at both sides. Specifically, the second gusset fabric positions underneath the first gusset fabric and sewn together with the first gusset fabric to connect to the waistband and the first panel. The cut-section provides access into an interior of the underwear through the second openings in order to allow ambidextrous access for left and right handed users.

In another aspect of the present invention, the underwear includes two layers of fabric starting from the center back at a seam along the buttocks, extending between the legs up the center front to the waistband. The interior gusset fabric (second gusset fabric) is attached along with an exterior gusset fabric (first gusset fabric) on either side of the leg holes to the main body fabric making up the leg of the garment, up until about 5", give or take, from the waistband, depending on sizing. The final approximate 5" have the edges bound in self fabric or elastic fold over elastic. The first gusset fabric extends from the back buttock seam under the legs, up the center front, to the waistband. The first gusset fabric is attached to the leg fabric panels (side panels) the whole way up. Starting approximately 5.25" below the waistband, the fabric opens up at the center front into a slit that extends back up to the waistband. The slit/cut-section is achieved with a secondary piece of fabric extending about 0.5" below the end of the cut-section, sewn right sides together with a very narrow seam allowance in a V-shape configuration from the center front top edge to the bottom of the slit opening and back up, slashed and then turned inside out, creating a clean finished center front fly opening. The top edges of the first gusset fabric are sewn into the waistband either touching each other or overlapping, about 0.25" to 0.5". The second gusset fabric top edge is also sewn into the waistband at the same time.

DETAILED DESCRIPTION OF EMBODIMENTS

Figure 1:
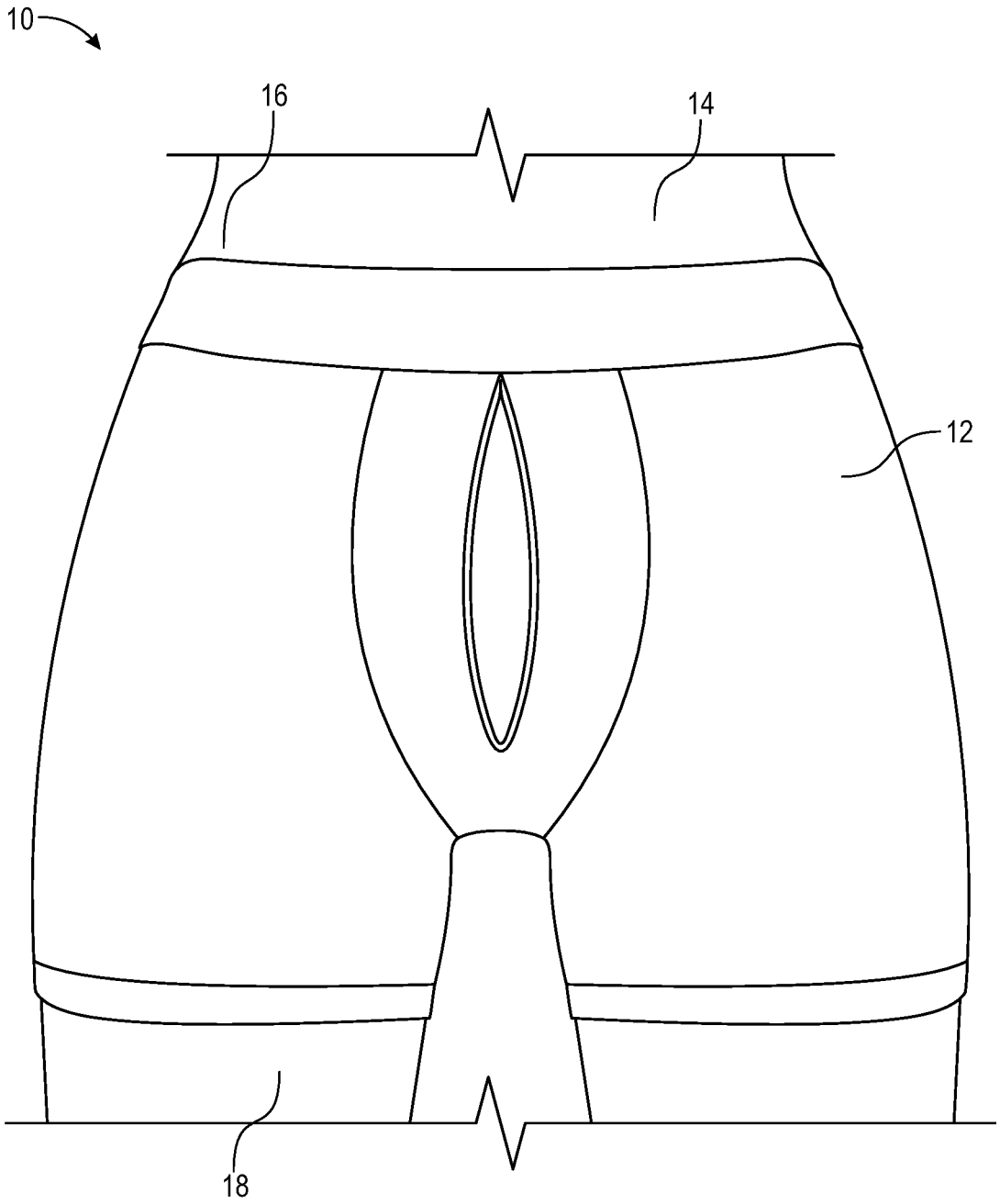
FIG. 1 illustrates an environment in which an underwear implements, in accordance with one embodiment of the present invention.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this application are hereby incorporated by reference in their entireties.

Figure 2A:
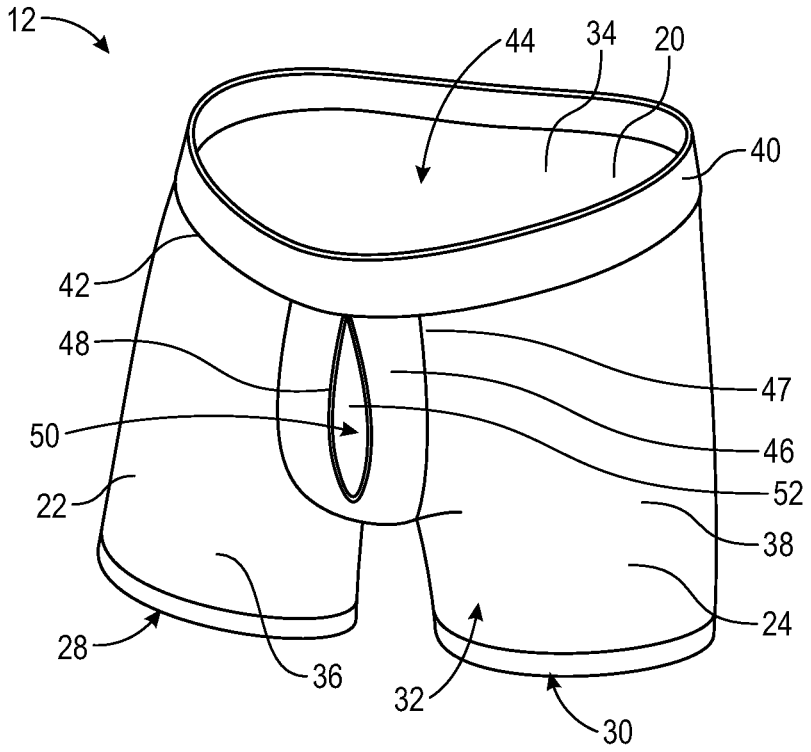
FIG. 2A and FIG. 2B illustrate a perspective view and a front view, respectively of the underwear, in accordance with one embodiment of the present invention.
Figure 2B:
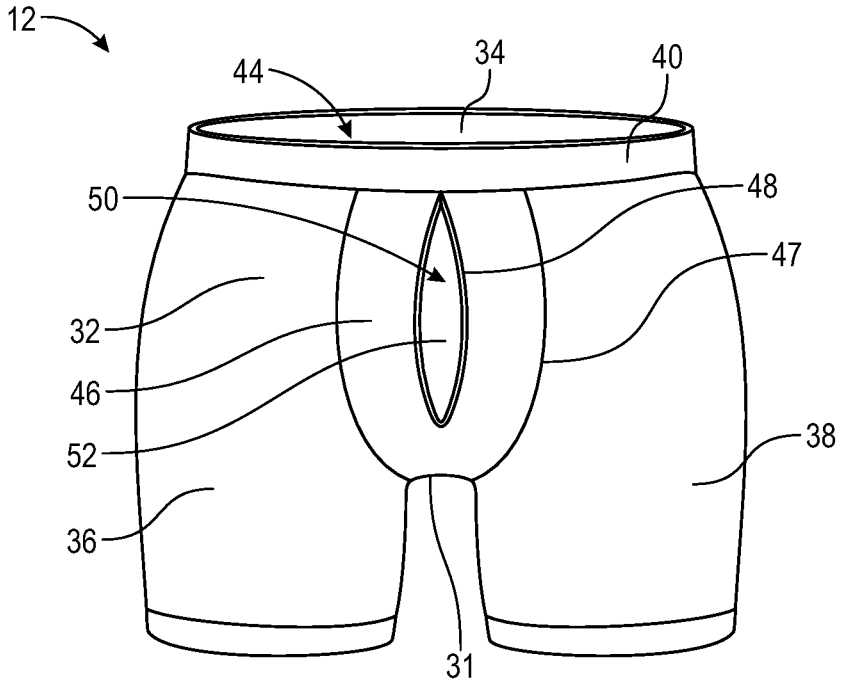

Turning to the Figures, FIG. 1 shows an environment 10 in which an underwear or undergarment 12 is used, in accordance with one embodiment of the present invention. Underwear 12 is worn by a user 14 around his waist 16 upon drawing through his/her legs 18. It should be understood that undergarment 12 includes, but not limited to, a brief, a bikini brief, a boxer brief, a boxer, a long underwear, a short, a trunk, and a combination thereof. FIG. 2A and FIG. 2B show a perspective view and a front view, respectively of underwear 12, in accordance with one embodiment of the present invention. Underwear 12 includes a first panel 20. First panel 20 indicates a buttock panel or a rear panel. Underwear 12 includes a first side panel 22 extending from first panel 20. Further, underwear 12 includes a second side panel 24 extending from first panel 20. Here, first side panel 22 forms a first leg opening 28 for receiving a leg say right leg 18 of user 14. Further, second side panel 24 forms a second leg opening 30 for receiving leg, say left leg 18 of user 14. Here, the front portion of first side panel 22 and second side panel 24 form a front body portion 32. First panel 24 forms a rear body portion 34. Further, first panel 24 and first side panel 22 with first leg opening 28 forms a first leg portion 36. Furthermore, first panel 24 and second side panel 24 with second leg opening 30 forms a second leg portion 38. In one example, first leg portion 36 indicates a right leg portion and second leg portion 38 indicates a left leg portion, or vice versa. In one example, first panel 20, first side panel 22, and second side panel 24 are formed from a single piece of cloth material. In one example, one or more of front body portion 32, rear body portion 34, first leg portion 36 and second leg portion 38 are made of a soft elasticized breathable mesh knit weave containing Nylon™ or cotton and Spandex™ fabric.

Further, underwear 12 includes a waistband 40 connected to front body portion 32, rear body portion 34, first leg portion 36 and second leg portion 38 at the top. In one example, waistband 40 connects to front body portion 32, rear body portion 34, first leg portion 36 and second leg portion 38 via a first seam 42. Waistband 40 along with front body portion 32, rear body portion 34, first leg portion 36 and second leg portion 38 form a body opening 44 at the top. In one example, waistband 40 is made of an elastic material. In another example, waistband 40 is made of a non-elastic material. A person skilled in the art understands that waistband 40 can come up with other components such as a drawstring, for example, to help to put on underwear 12 around the user's waist 16.

Figure 3:
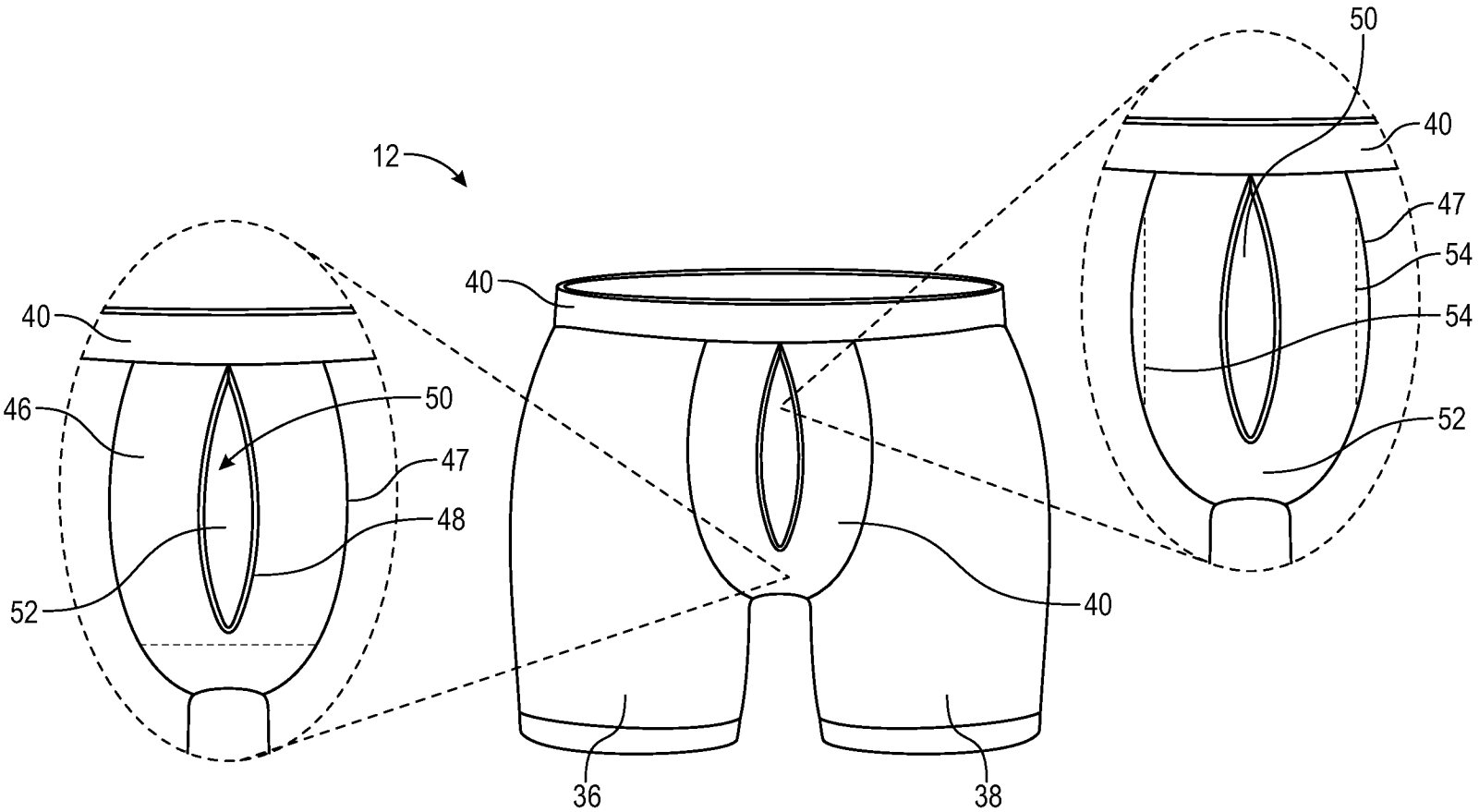
FIG. 3 illustrates an interior overlay construction details of a first gusset fabric and a second gusset fabric, in accordance with one embodiment of the present invention.

In accordance with the present invention, underwear 12 includes two layers of fabric, i.e., a first gusset fabric 46 and a second gusset fabric 52. FIG. 3 shows the interior construction overlay details having first gusset fabric 46 and a second gusset fabric 52. First gusset fabric 46 acts as an exterior or outer gusset fabric positioned at the front body portion 32 of underwear 12. Second gusset fabric 52 acts as an inner or interior fabric positioned underneath first gusset fabric 46. First gusset fabric 46 starts from first panel 20 from center back, extends between first side panel 22 and second side panel 24 up to the center front to waistband 40. In one example, the top edges of first gusset fabric 46 are sewn into waistband 40 either touching each other or overlapping about 0.25 to 0.5".

Here, first gusset fabric 46 is connected to first side panel 22, and second side panel 24 using a second seam 47. As can be seen, first gusset fabric 46 attaches to first side panel 22 and second side panel 24 the whole way up to waistband 40. In the present invention, first gusset fabric 46 comprises a cut-section or slit or first opening or fly 48 formed vertically. Cut-section 48 starts at about 0.25" below waistband 40 and extends until 0.5" at the bottom of first gusset fabric 46. Cut-section 48 forms a first gusset opening 50 in order to access the interior of underwear 12. In one example, first gusset opening 50 takes has a V-shape or oval configuration or any other shape depending on the need.

Further, underwear 12 includes second gusset fabric 52, as specified above. Second gusset fabric 52 acts as an inner gusset fabric positioned closer to the interior of underwear 12. In one embodiment, second gusset fabric 52 is attached underneath first gusset opening 50. Here, second gusset fabric 52 is attached along with first gusset fabric 46 on either side of first side panel 22 and second side panel 24 from waistband 40 up to first panel 20. In other words, second gusset fabric 52 is attached along with first gusset fabric 46 on either side of side panels 22, 24 to the main body fabric making up the leg of underwear 12, up until about 5", from waistband 40, depending on sizing. The final approximate 5" may have the edges bound in self fabric or elastic fold over elastic. In one example, the top edges of second gusset fabric 52 are sewn along with first gusset fabric 46 into waistband 40 using first seam 42. Second gusset fabric 52 positions underneath first gusset fabric 46 and forms second openings 54 from both sides. As such, first gusset fabric 46 has cut-section 48 at the center front and provides access to the interior of underwear 12 via second openings 54. First gusset fabric 46 and second gusset fabric 52 attach to a gusset 31 connecting first panel 20, first side panel 22 and second side panel 24.

In order to construct underwear 12, first panel 20, first side panel 22, second side panel 24, waistband 40, first gusset fabric 46 and second gusset fabric 52 are laid flat. A gusset binding is applied on both sides of second gusset fabric 52 at the front. Further, first gusset fabric 46 is aligned with second gusset fabric 52 at the front of gusset 31 with right sides together. Here, a mark is made to indicate the lowest point of fly opening i.e., cut-section 48 (first opening 50). Further, first gusset fabric 46 and a lining are sewn together with a V-shaped seam, starting about ¼" from the center top, sewing down to the lowest point of cut-section 48 as marked, pivoting, and sewing back up the top of gusset 31, about ¼" from the center on the other side.

Further, first gusset fabric 46 is slashed into and between the V-shaped seam all the way down to the lowest point. The lining is flipped through the slash such that wrong sides are together. The clean finished edge is pressed lightly. Furthermore, the first gusset fabric 46 is laid on top of second gusset fabric 52 matching at the center back, through the inseam area, and at the front top center. First side panel 22 and second side panel 24 are laid matching seams with fabric right sides together and serged together. A buttock seam is matched from the centers outwards with right sides together and serged together. Further, first side panel 22, second side panel 24 are rolled up approximately ½" and sewn. Subsequently, the ends of waistband 40 are sewn together to make one appropriately sized waistband 40 and connected to front panel 20, first side panel 22, and second side panel 24.

In one alternate embodiment, the edges of second gusset fabric 52 are finished with laser, fold over elastic, and a secondary piece of matching fabric, either ending a scant bit past the opening or extending fully back to the buttock seam, or any other means of clean finishing the edges are provided. Further, the edges of the cut-section 48 at first gusset fabric 46 are finished with laser, fold over elastic, and a secondary lining piece of matching fabric that extends fully back to the buttock seam. The opening i.e., cut-section 48 may not overlap at the top edge at waistband 40, just barely touch, or overlap further than 0.5". Cut-section 48 may open up into a slash in the middle of the fabric, rather than extending fully to the top waistband edge, leaving the width of fabric fully intact at the upper edge. Second gusset fabric 52 starts just below cut-section 48 of first gusset fabric 46, rather than extending fully back to the buttock area. Second gusset fabric 52 is either sewn to first gusset fabric 46 below cut-section 48, or remain unattached to the first gusset fabric 46, attached only at the leg holes i.e., first side panel 22, second side panel 24 and waistband 40.

Further, gusset 31 extends from right leg to left leg, rather than front to back. In such a case, second gusset fabric 52 begins at an inseam of first gusset fabric 46 such that first gusset fabric 46 connects in a variety of ways. In one example, first gusset fabric 46 remains as one piece of fabric, separate from the leg fabric (first side panel 22, second side panel 24), with a slash down the middle but not all the way to the bottom, clean finished. In another example, first gusset fabric 46 becomes two entirely separate pieces of fabric, connected at the inseam seam of gusset 31 and waistband 40, either overlapping each other or not, and connected to the leg fabric (first side panel 22, second side panel 24). This method can clean finish the fly edges by doubling the fabric over, self-binding, fold over elastic, laser finishing, or any other clean finishing method. In another example, first gusset fabric 46 becomes part of the leg fabric (first side panel 22, second side panel 24), creating one swathe of fabric extending from center front, around the hip, buttock, other hip and back to center front, either overlapping at center front, touching, or not overlapping. The edges may be clean finished by doubling the fabric back over, self-binding, fold over elastic, laser, or any other means of clean finishing edges.

In one alternate embodiment, first gusset fabric 46 includes a center seam extending from the bottom of cut-section 48 to the buttock seam, enabling the pattern to either—be made up of two doubled over lengths of fabric extending the full length of the gusset fly or be made up of two pieces of fabric, doubled over at the fly opening only, and extending slightly below the bottom of the fly opening.

Figure 4:
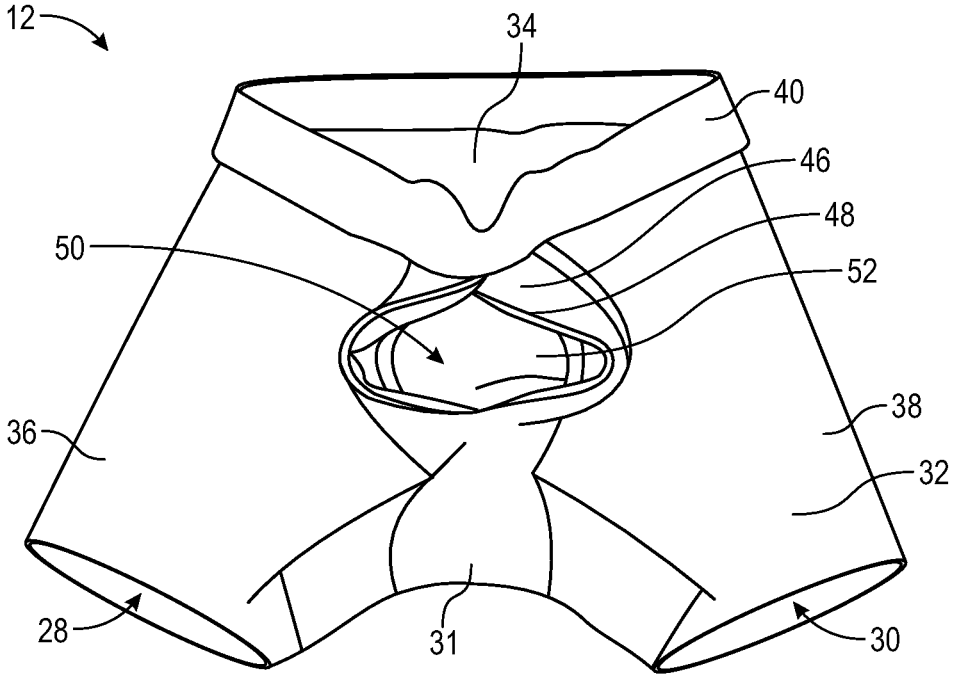
FIG. 4 illustrates a front outside, laid flat, fly, i.e., first gusset fabric having a cut-section in a fully expanded position, showing edges of the second gusset fabric, in accordance with one embodiment of the present invention.
Figure 5:
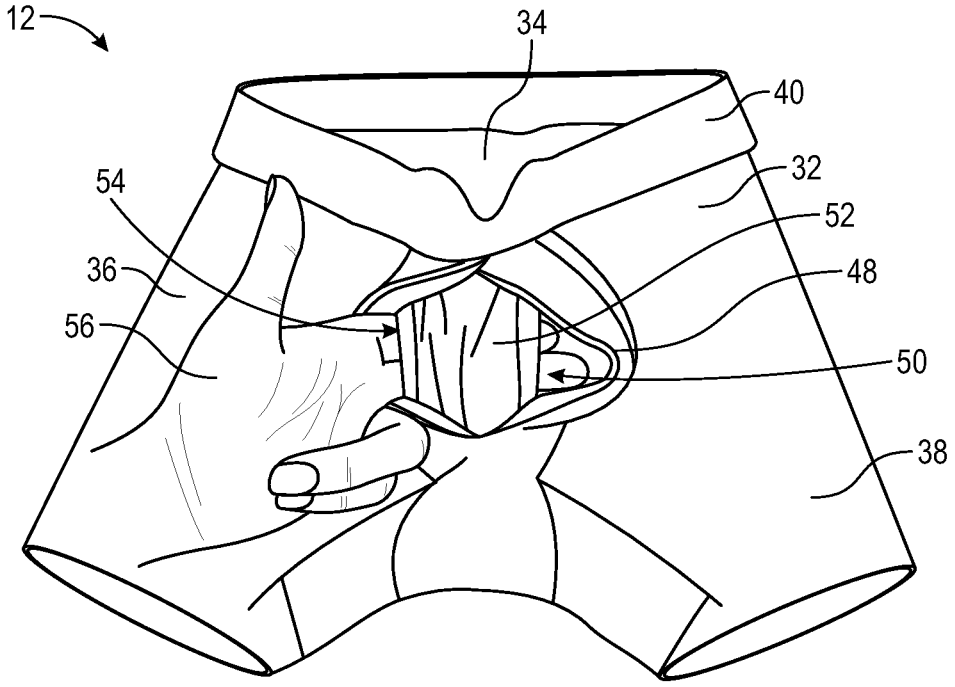
FIG. 5 illustrates a front outside, laid flat, fly, i i.e., first gusset fabric having a cut-section in a fully expanded position, showing ambidextrous access to genitals via the second gusset fabric, in accordance with one embodiment of the present invention.
Figure 6:
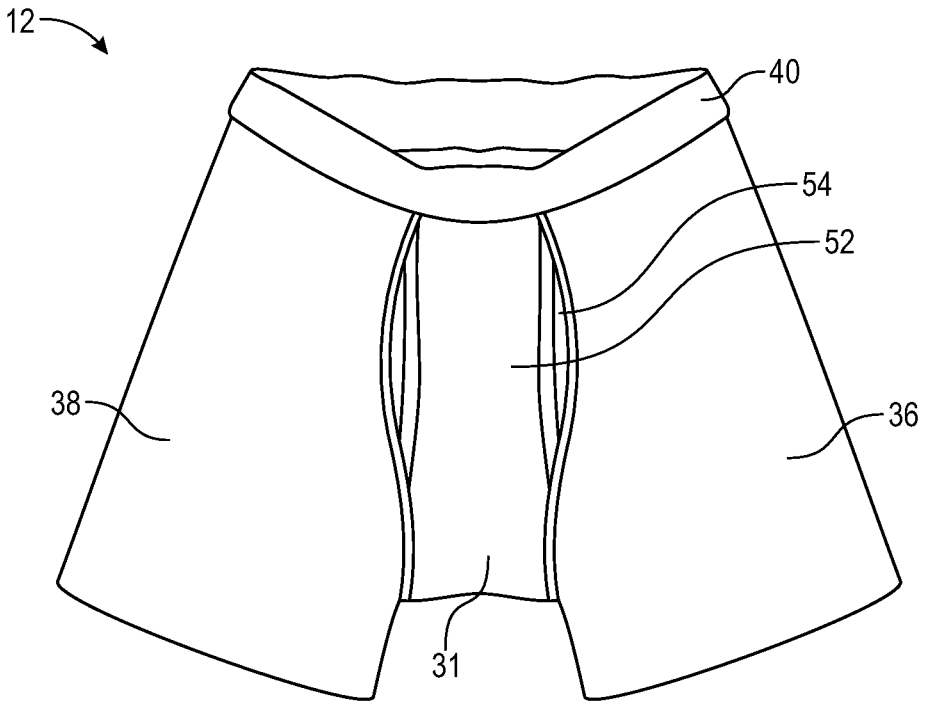
FIG. 6 illustrates a front inside, laid flat, fly, i.e., first gusset fabric in a closed position, showing the second gusset fabric, in accordance with one embodiment of the present invention.
Figure 7:
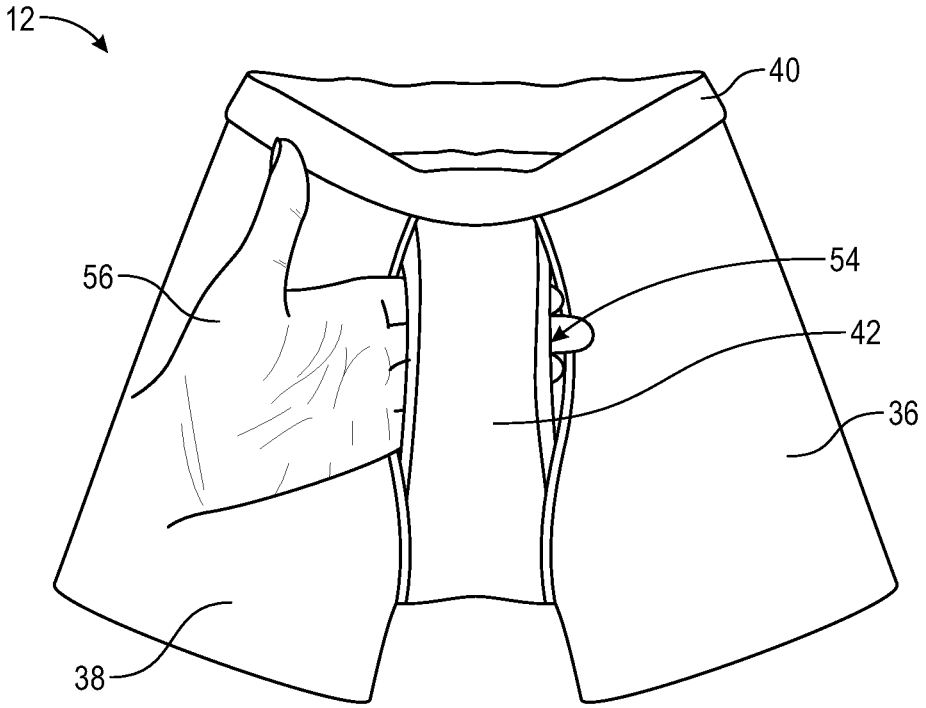
FIG. 7 illustrates a front inside, showing the second gusset fabric providing ambidextrous access to genitals, in accordance with one embodiment of the present invention.

FIG. 4 shows the feature of underwear 12 laid out flat and first gusset fabric 46 with cut-section 48 i.e., fly in fully expanded position showing second gusset fabric 52 (interior gusset edges) through it. FIG. 5 shows the feature of underwear 12 laid out flat and first gusset fabric 46 with cut-section 48 i.e., fly in fully expanded position showing ambidextrous access to genitals through second openings 54. FIG. 5 shows a hand 56 is inserted through second openings 54 to show how user 14 accesses the interior of underwear 12 from both sides through second openings 54. FIG. 6 shows underwear 12 laid flat inside out showing second gusset fabric 52 and second openings 54. Further, FIG. 7 shows the feature of underwear 12 laid flat inside out hand 56 inserted through second openings 54 providing ambidextrous access to genitals. This allows both male and females to use underwear 12.

From the above, it is evident that user 14 accesses the interior of underwear 12 through cut-section 48 and further through second openings 54 providing ambidextrous access to genitals for sanitary functions. In other words, first gusset fabric 46 opens up into a slit i.e., cut-section 48 at the center front. Below first gusset fabric 46 is a secondary piece of fabric i.e., second gusset fabric 52, which is attached at gusset 31 between side panels 22, 24, and then again at waistband 40. This creates an expandable pouch which accommodates male genitalia, or sits flat against the pubic bone with female genitalia. It also provides ambidextrous access to the genitals.

Figure 8:
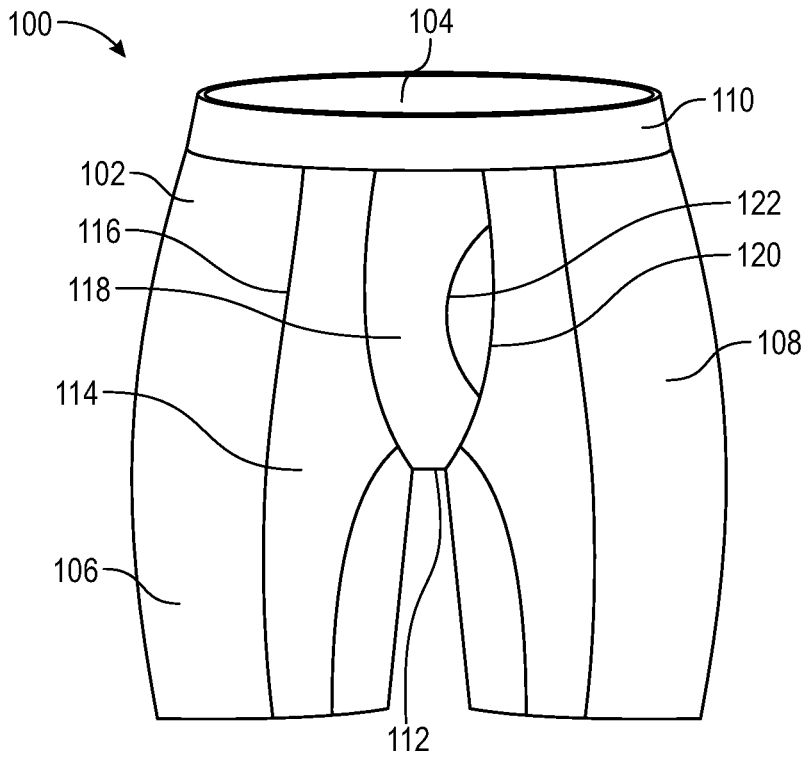
FIG. 8 illustrates a front view of an underwear showing a fly on the side, in accordance with another embodiment of the present invention.

Now referring to FIG. 8, an underwear 100 is shown, in accordance with another embodiment of the present invention. Here, underwear 100 includes a front portion 102, a rear portion 104, a first leg portion 106 and a second leg portion 108. First leg portion 106 indicates a right leg portion and second leg portion 108 indicates a left leg portion, or vice versa. Front portion 102, rear portion 104, first leg portion 106 and second leg portion 108 connect to a waistband 110 at the top. Further, front portion 102, rear portion 104, first leg portion 106 and second leg portion 108 connect to a gusset 112 at the crotch area. Further, first leg portion 106 and second leg portion 108 include a breathable fabric 114. Breathable fabric 114 connects to first leg portion 106 and second leg portion 108 via a first seam 116.

Further, underwear 100 includes a first gusset fabric 118 or fly at the front portion 102. In one example, first gusset fabric 118 connects to breathable fabric 114 and gusset 112 via a second seam 120. In the present embodiment, first gusset fabric 118 has an opening 122 positioning at a side for providing access for a male genital for sanitary functions. Underwear 100 further includes a second gusset fabric or inner gusset fabric (not shown, similar to second gusset fabric 52 explained above). The second gusset fabric positions underneath first gusset fabric 118 and provides ambidextrous access to the genital, as explained above. The present embodiment is shown to present opening 122 i.e., fly at side. Underwear 100 operates similar to underwear 12, as explained above.

Figure 9:
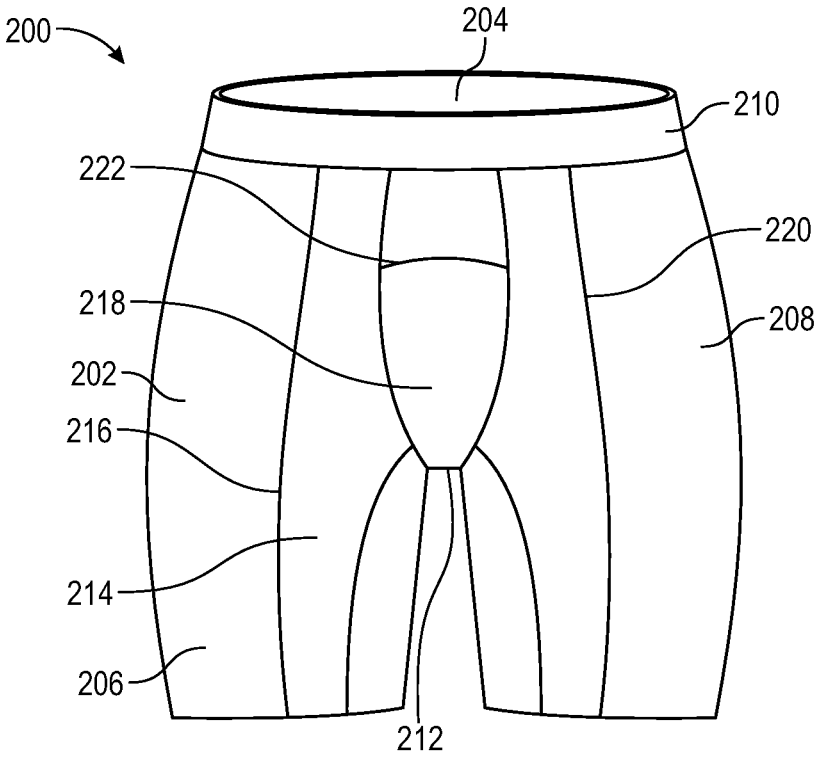
FIG. 9 illustrates a front view of an underwear showing a top down fly, in accordance with another embodiment of the present invention.

FIG. 9 shows an underwear 200, in accordance with another embodiment of the present invention. Here, underwear 200 includes a front portion 202, a rear portion 204, a first leg portion 206 and a second leg portion 208. First leg portion 206 indicates a right leg portion and second leg portion 208 indicates a left leg portion, or vice versa. Front portion 202, rear portion 204, first leg portion 206 and second leg portion 208 connect to a waistband 210 at the top. Further, front portion 202, rear portion 204, first leg portion 206 and second leg portion 208 connect to a gusset 212 at the crotch area. Further, first leg portion 206 and second leg portion 208 include a breathable fabric 214. Breathable fabric 214 connects to first leg portion 206 and second leg portion 208 via a first seam 216.

Further, underwear 200 includes a first gusset fabric 218 or fly at the front portion 202. In one example, first gusset fabric 218 connects to breathable fabric 214 and gusset 212 via a second seam 220. In the present embodiment, first gusset fabric 218 has an opening 222 in a top down configuration for providing access for a male or female genitalia for sanitary functions. Underwear 200 further includes a second gusset fabric or inner gusset fabric (not shown, similar to second gusset fabric 52 explained above). The second gusset fabric positions underneath first gusset fabric 218 and provides ambidextrous access to the genital, as explained above. The present embodiment is shown to present opening 222 i.e., top down fly. Underwear 200 operates similar to underwear 12, as explained above.

The above embodiments provide several advantages over the prior art. For example, the fly works equally well on male and female genitalia, allowing for a secure and snug fit, regardless of genitalia. This allows for an expanded market, as well as affirming usage for trans and non-binary people who may wear "packers" prosthetic male genitalia on certain occasions and no other times. Many female users enjoy wearing boxer briefs due to the comfort and coverage, but are consistently met with gapping, pouching and wrinkles, and all around poor fit. On female genitalia, excess fabric pouches out. Traditional men's underwear fly's only fit male genitalia. The presently disclosed underwear works equally well for male and female genitalia, as well as provides ambidextrous access, left and right handed people. Further, the presently disclosed underwear with fly lays flat against female genitalia without gapping, wrinkles or pouching, creating a more secure and comfortable fit. Additionally, the ambidextrous access allows equally easy usage by both left and right handed people. Further, the expandable pouch more snugly and comfortably fits a range of genitalia size across the board.

Further, the unique design of fly accommodates all sizes of genitalia, creating a better fit on females who often enjoy wearing boxer briefs but end up with pouching when they wear typical men's underwear. This also allows for access on either side, allowing more comfortable access for left handed people who typically are forced to use right handed flies.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

Clause 1. An underwear, comprising: a first panel; a first side panel extending from said first panel; a second side panel extending from said first panel; a waistband, wherein said waistband connects at a top of said first panel, said first side panel and said second side panel; a first gusset fabric attached to said first panel, said first side panel, said second side panel and said waistband, wherein said first gusset fabric comprises a cut-section; and a second gusset fabric attached to said first panel and said waistband, wherein said second gusset fabric positions underneath said first gusset fabric and forms second openings at both sides with said first gusset fabric, wherein said cut-section provides access into an interior of said underwear through said second openings in order to allow ambidextrous access for left and right handed users.

Clause 2. The underwear of Claim 1, wherein said underwear is one of a brief, a bikini brief, a boxer brief, a boxer, a long underwear, a short, a trunk, and combination thereof.

Clause 3. The underwear of Claim 1, wherein said first panel, said first side panel, said second side panel, said first gusset fabric and said second gusset fabric connect to said waistband at the top.

Clause 4. The underwear of Claim 1, wherein said underwear further comprises a gusset positioned below said first gusset fabric and said second gusset fabric.

Clause 5. The underwear of Claim 1, wherein said first panel forms a rear body portion of said underwear.

Clause 6. The underwear of Claim 5, wherein each of said first side panel and said second side panel form a leg portion for receiving a leg of a user.

Clause 7. The underwear of Claim 1, wherein said first side panel, said second side panel, said first gusset fabric and said second gusset fabric form a front body portion of said underwear.

Clause 8. The underwear of Claim 1, wherein said cut-section positions vertically with respect to said first side panel and said second side panel.

Clause 9. The underwear of Claim 1, wherein said cut-section positions in a top down configuration.

Clause 10. The underwear of Claim 1, wherein said cut-section positions at a side of said first gusset fabric in a curved configuration.

Clause 11. The underwear of Claim 1, wherein said second gusset fabric positions underneath said first gusset fabric and sewn together with said first gusset fabric to connect to said waistband at the top and said first panel at a bottom.

Clause 12. The underwear of Claim 1, wherein said first gusset fabric and said second gusset fabric lay flat against female genitalia without gapping.

Clause 13. The underwear of Claim 1, wherein said waistband, said first panel, said first side panel, and said second side panel form a body opening to receive a body of a user.

Clause 14. The underwear of Claim 1, wherein said first panel, said first side panel, and said second side panel are formed of a single piece of cloth material.

Clause 15. A method of providing an underwear, said method comprising steps of: providing a first panel; providing a first side panel extending from said first panel; providing a second side panel extending from said first panel; providing a waistband connecting at a top of said first panel, said first side panel, and said second side panel; providing a first gusset fabric attached to said first panel, said first side panel, said second side panel and said waistband; providing a cut-section at said first gusset fabric; providing a second gusset fabric attached to said first panel and said waistband, said second gusset fabric positioning underneath said first gusset fabric and forming second openings at both sides with said first gusset fabric; and providing access into an interior of said underwear via said cut-section and said second openings in order to allow ambidextrous access for left and right handed users.

Clause 16. The method of Claim 15, further comprising providing a gusset below said first gusset fabric and said second gusset fabric.

Clause 17. The method of Claim 15, further comprising providing said cut-section in a vertical configuration with respect to said first side panel, and said second side panel.

Clause 18. The method of Claim 15, further comprising providing said cut-section in a top down configuration.

Clause 19. The method of Claim 15, further comprising providing said cut-section at a side of said first gusset fabric in a curved configuration.

Clause 20. The method of Claim 15, further comprising laying said first gusset fabric and said second gusset fabric flat against female genitalia without gapping.

What is claimed is:

1. An underwear, comprising:

a first panel;

a first side panel extending from said first panel;

a second side panel extending from said first panel;

a waistband, wherein said waistband connects at a top of said first panel, said first side panel and said second side panel;

a first gusset fabric attached to said first panel, said first side panel, said second side panel and said waistband, wherein said first gusset fabric comprises a cut-section; and a second gusset fabric positioned underneath and aligned with said first gusset fabric and connected to said waistband at the top and said first panel at the bottom forming second openings at both distal sides underneath and with respect to said first gusset fabric, wherein said cut-section provides access into an interior of said underwear through said second openings in order to allow ambidextrous access for left and right handed users.

2. The underwear of claim 1, wherein said underwear is one of a brief, a bikini brief, a boxer brief, a boxer, a long underwear, a short, a trunk, and combination thereof.

3. The underwear of claim 1, wherein said first panel, said first side panel, said second side panel, said first gusset fabric and said second gusset fabric connect to said waistband at the top.

4. The underwear of claim 1, wherein said underwear further comprises a gusset positioned below said first gusset fabric and said second gusset fabric.

5. The underwear of claim 1, wherein said first panel forms a rear body portion of said underwear.

6. The underwear of claim 5, wherein each of said first side panel and said second side panel form a leg portion for receiving a leg of a user.

7. The underwear of claim 1, wherein said first side panel, said second side panel, said first gusset fabric and said second gusset fabric form a front body portion of said underwear.

8. The underwear of claim 1, wherein said cut-section positions vertically with respect to said first side panel and said second side panel.

9. The underwear of claim 1, wherein said cut-section positions in a top down configuration.

10. The underwear of claim 1, wherein said cut-section positions at a side of said first gusset fabric in a curved configuration.

11. The underwear of claim 1, wherein said first gusset fabric and said second gusset fabric lay flat against female genitalia without gapping.

12. The underwear of claim 1, wherein said waistband, said first panel, said first side panel, and said second side panel form a body opening to receive a body of a user.

13. The underwear of claim 1, wherein said first panel, said first side panel, and said second side panel are formed of a single piece of cloth material.

* * * * *